United States Patent [19]

Yoshioka

[11] 3,978,665

[45] Sept. 7, 1976

[54] OIL HYDRAULIC MOTOR

[76] Inventor: Hideaki Yoshioka, No. 20-31, 4-chome, Suizenji, Kumamoto, Japan

[22] Filed: Jan. 31, 1975

[21] Appl. No.: 545,901

[52] U.S. Cl. ..... 60/325; 60/464; 60/483; 60/484; 60/486; 418/60; 418/210

[51] Int. Cl.[2] ..... F15B 13/06

[58] Field of Search ..... 60/325, 375, 484, 486, 60/464, 483, 539, 537; 91/170, 411 A; 418/60, 210

[56] References Cited

UNITED STATES PATENTS

| | | | |
|---|---|---|---|
| 2,374,588 | 4/1945 | Doran | 60/425 |
| 2,391,996 | 1/1946 | Muller | 60/539 X |
| 3,120,103 | 2/1964 | Beard et al. | 60/486 X |
| 3,655,004 | 4/1972 | Hoashi | 60/483 X |

*Primary Examiner*—Edgar W. Geoghegan
*Attorney, Agent, or Firm*—Oblon, Fisher, Spivak, McClelland & Maier

[57] ABSTRACT

An oil hydraulic motor is provided with a casing in which a rotor is disposed in an eccentric position. An oil having a preselected pressure is sealed in the chambers defined between the rotor and the inner wall surfaces of the chambers and a high pressure is intermittently propagated into said chambers from a high pressure generating device with which it is in communication thereby rotating said rotor to develop an output.

4 Claims, 8 Drawing Figures

FIG.1
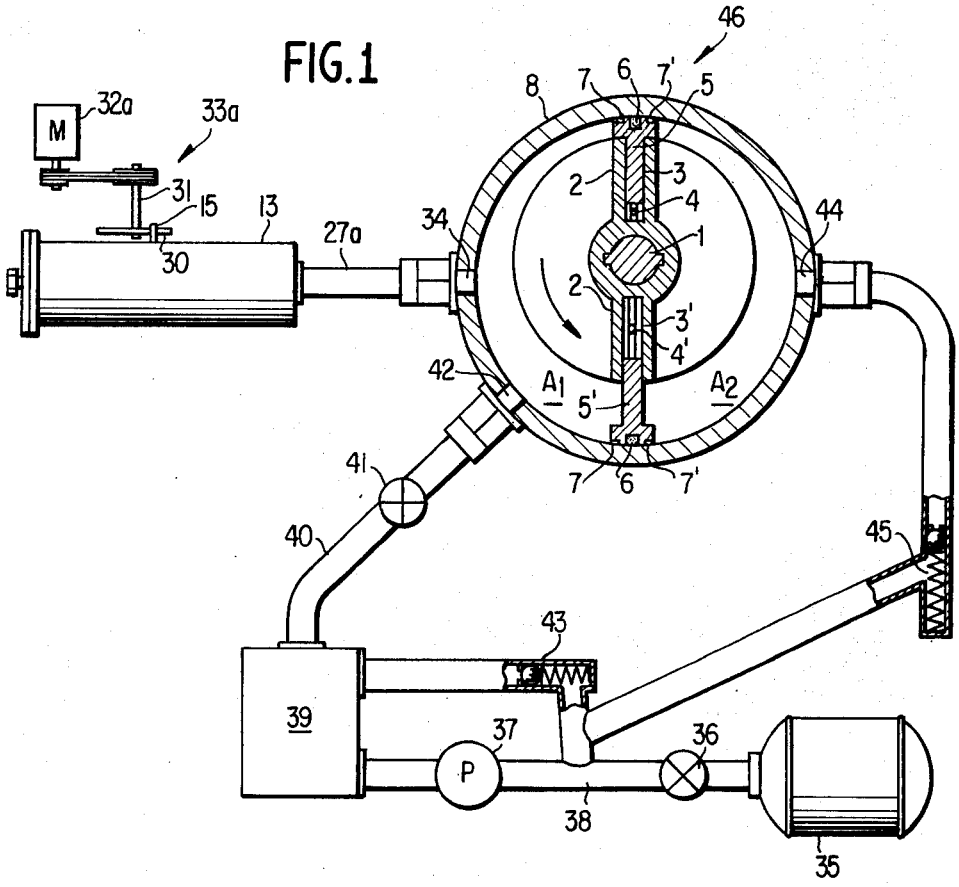
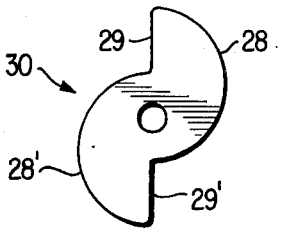
FIG.2
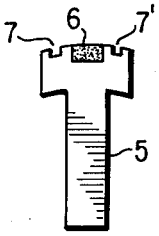
FIG.3
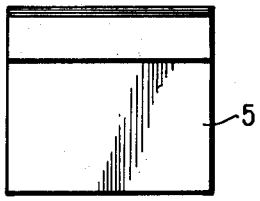
FIG.4
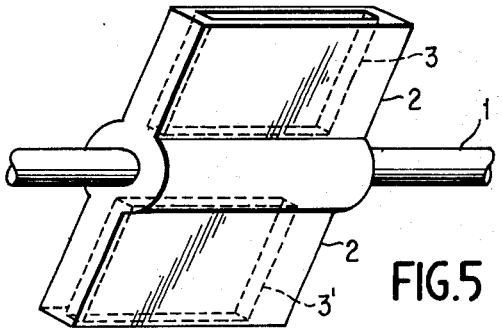
FIG.5

OIL HYDRAULIC MOTOR

BACKGROUND OF THE INVENTION

With the development of modern industrial techniques, no single year has passed recently without seeing newly developed automobile engines and other various types of engines having increasingly larger precision designs. Today, it is our common knowledge that irrespective of their compact designs modern engines can develop large powers. Most of these engines, however, are so designed as to develop an output by actuating their pistons or rotors with pressure developed from an explosive combustion of an air/fuel mixture. The operation of these engines, therefore, inevitably accompanies a development of exhaust gas which causes air pollution and other various public nuisances. Besides, these engines mostly employ petroleum as their fuel, the limited resources of which is one of the greatest problems that is now being faced by the present world. In view of these circumstances, it is most desired by various industrial fields to develop a low cost engine which can take the place of conventional gasoline engines.

OBJECT OF THE INVENTION

It is therefore a primary object of this invention to eliminate the aforementioned disadvantages involved in conventional internal combustion engines. Another object of this invention is to provide an improved oil hydraulic motor which provides an output efficiently by an intermittent propagation of a high pressure in the motor chambers but not passing a high pressure oil through the motor casing as in conventional oil hydraulic motors. Still another object of this invention is to provide an improved oil hydraulic motor which does not develop any exaust gas and hence involves no danger of air pollution which has become a great social problem of today's world.

According to this invention, these objects are achieved by an oil hydraulic motor composed of a main shaft, an auxiliary shaft directly coupled to said main shaft, a pair of rotary type drive units adapted to drive said main and auxiliary shafts, a pair of high pressure generating units adapted to feed a high pressure oil intermittently into the corresponding drive units, and an oil circulating system for said drive units. The drive unit for said main shaft is provided with a rotor having a pair of shield elements, whereas the drive unit for said auxiliary shaft is provided with a rotor having a triangular cross section. On application of the high pressure oil fed from said high pressure generating units, these rotors are rotated to drive the main and auxiliary shafts. Said drive units are provided with a system adapted to circulate the high pressure oil which has entered the motor casings. Said oil circulating system includes a pump, a pressure tank and an oil tank. Each of said high pressure generating units includes a cam which is rotated by a separately arranged motor and a piston actuated by said cam.

BRIEF DESCRIPTION OF THE DRAWINGS

FIG. 1 is a partial cross sectional front elevation of the main shaft drive unit for use in the oil hydraulic motor according to the embodiment of this invention;

FIG. 2 is an enlarged plan view of the cam according to this invention;

FIG. 3 is an enlarged end view of the shield element for use in the oil hydraulic motor of this inventon;

FIG. 4 is an enlarged front elevational view of the shield element shown in FIG. 3;

FIG. 5 is an enlarged perspective view of the rotor mounted on the main shaft;

DESCRIPTION OF THE PREFERRED EMBODIMENT

Figure 8:
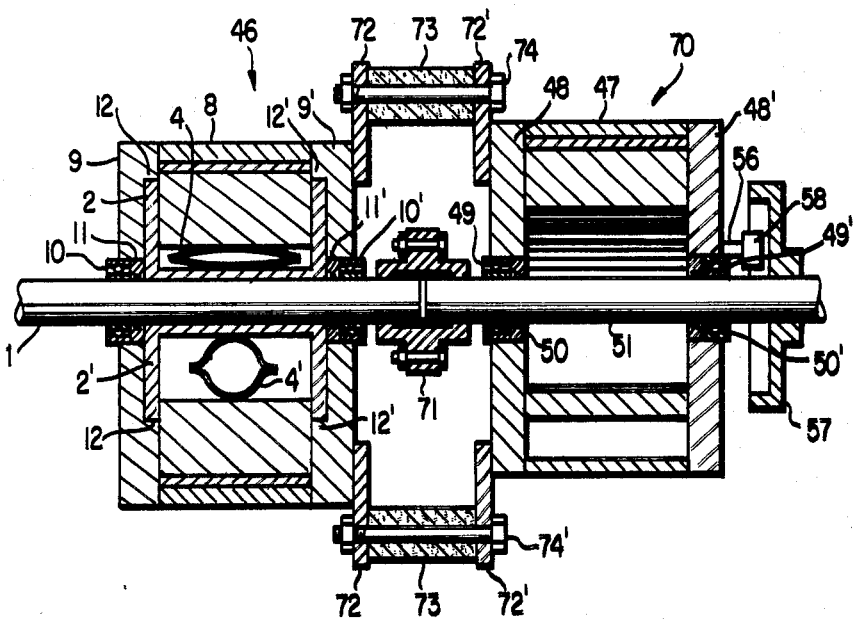
FIG. 8 is an entire vertical sectional view of the associate pair of drive units.

As will be seen from the vertical section of FIG. 8, the oil hydraulic motor of this invention is composed of a main shaft 1, an auxiliary shaft 51 disposed in line with and directly coupled to said main shaft 1 and a pair of drive units 46 and 70 which are associated with said main and auxiliary shafts 1 and 51, respectively. First, the drive unit 46 for the main shaft 1 will be described with reference to FIG. 1. A prismatic/circular cylindrical rotor 2 is fixedly attached to the main shaft 1, and leaf springs 4 and 4' as well as shield elements 5 and 5' are inserted into a pair of holes 3 and 3' formed in the rotor 2. In the top surfaces of the shield bodies 5 and 5' are centrally cut grooves in which a pair of packings 6 are engaged. On both sides of said packing grooves are cut oil grooves 7 and 7'. To the front 9 and rear 9 end plates of the circular cylindrical casing 8 are eccentrically attached bearings 10 and 10' and packings 11 and 11'. The main shaft 1 is supported at its opposite ends by said bearings 10 and 10' so that the top surfaces of said shield bodies 5 and 5' are in slidable contact with the inner wall surface of the casing 8 and the end surfaces of said shield elements 5 and 5' are in slidable contact with eccentrically stepped portions 12 and 12' inwardly projecting from the inner peripheral surfaces of said end plates 9 and 9'.

Figure 6:
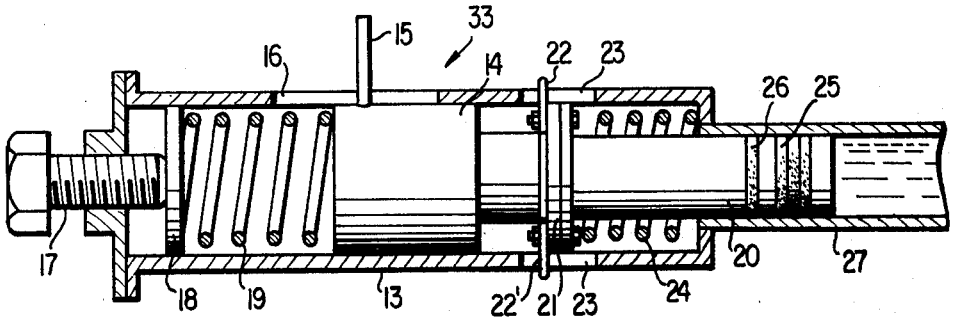
FIG. 6 is an enlarged cross sectional view of the high pressure generating unit.

As is best seen from FIG. 6, a hammer 14 is received in a cylinder 13 so that an actuating rod 15 of the hammer 14 projects outwardly through an elongate hole 16 formed in the side wall of the cylinder 13. In the rear end of the cylinder 13 is inserted a retainer 18 so that it is adjustable by means of a bolt 17. A spring 19 is loaded in the cylinder 13 between the retainer 18 and the rear end surface of the hammer 14. In the forward end portion of the cylinder 13 is received a piston 20 which carries on its rear end surface a pair of arresting rods 22 and 22' at upper and lower positions. These arresting rods 22 and 22' extend into elongate holes 23 and 23' which are formed in the cylinder 13 at diametrically opposite upper and lower positions. A spring 24 is disposed around the piston 20 so that the opposite ends of the spring 24 are engaged with a flange 21 on the piston 20 and with the forward end inner wall surface of the cylinder 13. A packing 25 and an O-ring 26 are engaged on the head of the piston 20 and the forward end portion of the piston 20 is inserted into a pipe 27 which is in communication with the inner bore of the cylinder 13 at its forward end position. A cam 30 formed by connecting the associate ends of two similar eccentric arcuate surfaces 28 and 28' by two vertical flat surfaces 29 and 29' (FIG. 2) is fixedly mounted on the lower end of a rotary shaft 31 so that these surfaces are in slidable contact with the hammer actuating rod 15 projecting outwardly through the elongate hole 16 formed in the cylinder 13. A high pressure generating unit 33*a* is formed by associating said rotary shaft 31 with a motor 32*a* by means of a belt and pulleys. The outlet of said high pressure generating unit 33*a* is communicated into a pressure supply port 34 by way of a pipe 27*a*, said pressure supply port 34 opening into a side wall portion of the casing 8 at the center position thereof. A valve 36 and a pump 37 are in communication with an oil tank 35 by way of a pipe 38 of which the outlet end is in communication with a pressure tank 39. A pipe 40 connected at one end to said pressure tank 39 is communicated with an inlet port 42 opening at a position slightly below the pressure supply port 34 in the casing 8, and between the pressure tank 39 and pipe 38 there is arranged a relief valve 43 disposed within a conduit, not numbered. In opposition to the pressure supply port 34, there is formed a pressure discharge port 44 within the opposite side wall portion of the casing 8. The pressure discharge port 44 is communicated with the pipe 38 by way of a relief valve 45.

Figure 7:
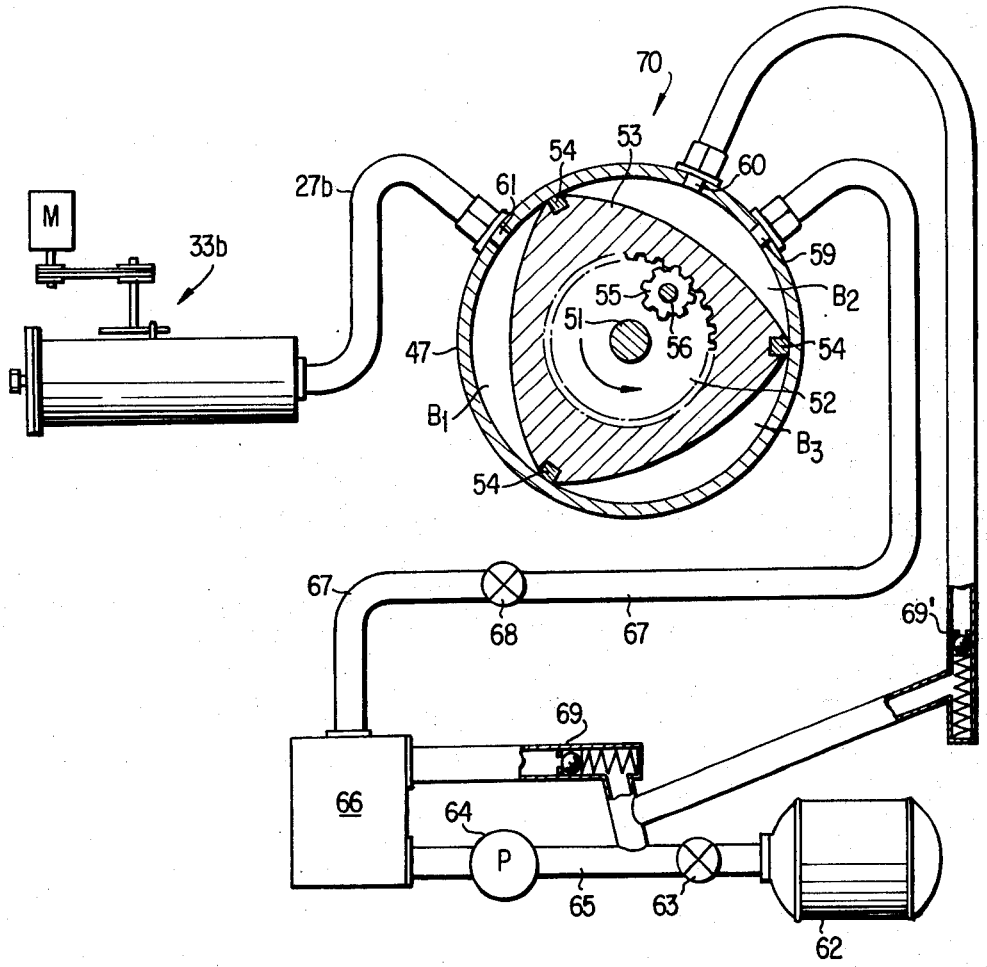
FIG. 7 is a partial cross sectional front elevation of the auxiliary shaft drive unit.

Now the drive unit 70 for the auxiliary shaft 51 will be described with reference to FIGS. 7 and 8. Bearings 49 and 49′ and packings 50 and 50′ are centrally fixed to front 48 and rear 48 end plates of a circular cylindrical casing 47 surrounding the auxiliary shaft 51 for supporting the same. A rotor 53 having a nearly triangular prismatic configuration and carrying an integrally formed internal gear 52 includes three symmetrical projected portions, each carrying a shield element 54 engaged therein. Said triangular prismatic rotor 53 is received in the casing 47 so that the shield elements 54 are in slidable contact with the inner wall surface of the casing 47. A shaft 56 fixedly carrying a guide gear 55 is supported at the opposite ends thereof by said front and rear end plates 48 at an eccentric position so that the guide gear 55 is engaged with said internal gear 52 formed on the triangular prismatic rotor 53. On one end of the auxiliary shaft 51 is fixed an internal gear 57 and on one end of the shaft 56 which projects outwardly through the rear end plate 48′ is fixed a gear 58 so that this gear 58 is engaged with said internal gear 57. An inlet port 59 and an outlet port 60 are formed in the casing 47 in an upper central area thereof; whereas a pressure supply port 61 is formed through a side wall portion of the casing 47 at a symmetrical position with respect to a vertical plane including the axis of the casing 47.

Another high pressure generating unit 33*b* having a construction similar to said high pressure generating unit 33*a* is arranged in association with the drive unit 70. Said high pressure generating unit 33*b* has an outlet port communicated with the pressure supply port 61 formed in the casing 47 by way of a pipe 27*b*. An oil tank 62 is in communication with a pressure tank 66 by way of a valve 63, pipe 65 and pump 64. A pipe 67 having one end connected to said pressure tank 66 is arranged in communication with the inlet port 59 by way of a valve 68. The pressure tank 66 is communicated with the pipe 65 by way of a relief valve 69 disposed within a conduit, not numbered. The outlet port 60 and pipe 65 are in communication with each other by way of a relief valve 69′.

The above-described two drive units 46 and 70 are coaxially arranged end to end and the main shaft 1 and auxiliary shaft 51 are connected together by means of a coupler 71. At the opposite positions on the rear end plate 9′ for the drive unit 46 and on the front end plate 48 for the drive unit 70 are attached metal elements 72 and 72′ so that these metal elements 72 and 72′ can be fastened together by means of a pair of bolts and nuts 74 and 74′.

Now the operation of the oil hydraulic motor with the above-described construction will be explained with reference to the accompanying drawings. According to this invention, the casings 8 and 47 are fixed on a base or the like. In the drive unit 46, the oil in the oil tank 35 is pressurized by the pump 37 and then stored in the pressure tank 39. The highly pressurized oil is then fed through the pipe 40 into the chambers A1 and A2 partitioned by the rotor 2 disposed in the casing 8, so that these chambers A1 and A2 are always filled with the pressurized oil.

When the rotary shaft 31 of the high pressure generating unit 33*a* is rotated by the motor 32*a*, the cam 30 rotates while keeping its arcuate surfaces 28 and 28′ in slidable contact with the actuating rod 15 of the hammer 14 which is received in the cylinder 13, so that the hammer 14 is urged against the action of the spring 19. At the moment when the actuating rod 15 is disengaged from the arcuate surfaces 28 and 28′ at the vertical flat surfaces 29 and 29′, the hammer 14 more rapidly in the forward direction to strike the rear end of the piston 20. Consequently, the piston 20 is forcibly displaced in the forward direction against the action of the spring 24 to develop a high pressure within the oil disposed in the pipe 27. The high pressure is in turn propagated into the casing 8. When a high pressure is propagated into the oil present within the chamber A1, which chamber is in communication with the pipe 27, at a position relative to the rotor 2 which has been rotated in the direction of the arrow so as to define a slight angle from the horizontal position, then the rotor 2 will start rotating in this direction by the moment of force, which acts on the rotor 2 due to the action of the propagated high pressure, because the main shaft 1 of the rotor 2 is disposed in the casing in an upwardly eccentric position. As the rotor 2 rotates, a high pressure is propagated from the high pressure generating unit 33*a* into the chambers A1 and A2. Under these conditions, the chambers A1 and A2 alternately repeat their compression and expansion strokes. In the expansion stroke of the chambers A1 and A2, high pressure oil flows into these chambers A1 and A2 at the inlet port 42 via the pipe 40 which is in communication with the pressure tank 39. In the compression stroke of the chambers A1 and A2, the oil present within these chambers flows out of them at the outlet port 44, so that the oil pressures within the chambers A1 and A2 are maintained at an equal level.

In the drive unit 70 for the auxiliary shaft 51, chambers B1, B2 and B3 are defined by the inner wall surface of the casing 47 and the outer surface of the nearly triangular prismatic rotor 53. At the time when each of these chambers B1, B2 and B3 is respectively communicated with the inlet port 59, high pressure oil is introduced from the pressure tank 66 into the particular chamber. At the upper left position, each chamber B1, B2 or B3 is isolated from both the inlet port 59 and outlet port 60. Under these conditions, when a high pressure is propagated through the pipe 27*b* from the high pressure generating unit 33*b* into the corresponding chamber, the triangular prismatic rotor 53 rotates in the direction of the arrow shown in FIG. 7 due to the moment of force which is applied to the rotor 53 by the high pressure, the fulcrum of the moment being the guide gear 55. As a result, the guide gear 55 engaged with the internal gear 52 of the triangular prismatic rotor 53 is rotated, thereby transmitting the torque generated by the triangular prismatic rotor 53 to the auxiliary shaft 51 through the engagement between the gear 58 fixedly mounted on one end of the shaft 56 and the internal gear 57 fixedly mounted on one end of the auxiliary shaft 51. During one revolution of the triangular prismatic rotor 53, the high pressure generating unit 33*b* actuates the hammer three times to propagate a high pressure in each chamber B1, B2 and B3. When the high pressure generating units 33*a* and 33*b* are operated alternately at suitable intervals, the torque developed on the rotors 2 and 53 may be transmitted to some other mechanism by means of the main shaft 1 and auxiliary shaft 51.

Unlike the conventional internal combustion engines, the oil hydraulic motor of this invention does not develop any exhaust gas and, besides, it can develop a higher output at higher efficiency compared with any conventional motors of similar types.

What is claimed is:

1. An oil hydraulic motor comprising:

a main shaft;

an auxiliary shaft disposed in line with and directly coupled to said main shaft;

a pair of rotary type drive units, each including a casing which has a built-in rotor, being connected respectively to the main shaft and the auxiliary shaft;

said rotor of the drive unit connected to the main shaft being disposed in the corresponding casing at an eccentric position and a pair of shield elements being arranged thereon at diametrically opposite positions;

said rotor of the drive unit for the auxiliary shaft having a nearly triangular prismatic configuration and carrying an integrally formed internal gear, and a guide gear being supported at a predetermined position so that it is engaged with said internal gear formed on the triangular prismatic rotor and is operative in association with said auxiliary shaft;

a pair of high pressure generating units adapted to intermittently supply a high pressure oil into the corresponding casings of these drive units; and a pair of oil circulating systems, each including a pressure tank and a pump disposed in the piping communicating the different chambers defined in said casings with each other.

2. An oil hydraulic motor comprising:

a main shaft;

an auxiliary shaft disposed in line with and directly coupled to said main shaft;

a pair of rotary type drive units, each including a casing which has a built-in rotor, being connected respectively to the main shaft and the auxiliary shaft;

a pair of high pressure generating units adapted to intermittently supply a high pressure oil into the corresponding casings of these drive units, wherein each of said high pressure generating units comprises a cam driven by a motor, a hammer intermittently displaced in the axial direction by means of said cam, a spring normally urging said hammer in the forward direction, a piston engageable with the front end surface of said hammer, a spring normally urging said piston rearwards, and a casing adapted to receive said springs, hammer and piston; and a pair of oil circulating systems, each including a pressure tank and a pump disposed in the piping communicating the different chambers defined in said casings with each other.

3. An oil hydraulic motor according to claim 1 wherein each of said oil circulating systems comprises: relief valves and a stop valve arranged in the piping.

4. An oil hydraulic motor according to claim 2, wherein each of said oil circulating systems comprises relief valves and a stop valve arranged in the piping.

* * * * *